United States Patent [19]

Heinol

[11] 4,424,910

[45] Jan. 10, 1984

[54] CHILD RESISTANT CAP HAVING CAP RETENTION AND CAM SURFACES

[75] Inventor: Alois R. Heinol, Bensenville, Ill.

[73] Assignee: Knight Engineering & Molding Co., Arlington Heights, Ill.

[21] Appl. No.: 415,388

[22] Filed: Sep. 7, 1982

[51] Int. Cl.[3] ..... B65D 55/02

[52] U.S. Cl. ..... 215/216; 215/237; 222/153

[58] Field of Search ..... 215/216, 237, 235; 222/153

[56] References Cited

U.S. PATENT DOCUMENTS

| | | | |
|---|---|---|---|
| Re. 29,793 | 10/1978 | Pehr | 222/153 |
| 3,593,879 | 7/1971 | Gach | 220/60 |
| 3,826,394 | 7/1974 | Stull | 215/9 |
| 3,877,598 | 3/1975 | Hazard | 215/224 |
| 4,047,495 | 9/1977 | O'Brian | 215/224 |
| 4,353,483 | 10/1982 | Pehr | 222/153 |
| 4,378,073 | 3/1983 | Luker | 215/237 |

*Primary Examiner*—George T. Hall

*Attorney, Agent, or Firm*—Kinzer, Plyer, Dorn & McEachran

[57] ABSTRACT

A child resistant cap comprises a generally circular cap member having an inwardly projecting lip on the underside. When the cap is closed the lip engages a retention element formed in a second lip which surrounds the outlet of a tubular body portion. The body portion is molded into the top of a container. The cap and body portions are preferably connected by a strap and there may be a locking tab to secure the cap firmly in the seated position. The lip on the tubular body portion has a first, cam surface sloping from one side of the lip toward the other to assist in spreading the cap lip when seating the cap on the body portion. A second, undercut surface, contiguous with the first cam surface, forms a retention element which holds the cap in place.

5 Claims, 7 Drawing Figures

CHILD RESISTANT CAP HAVING CAP RETENTION AND CAM SURFACES

SUMMARY OF THE INVENTION

This invention relates to a child resistant plastic cover assembly for a container.

The invention is particularly concerned with a child resistant plastic cover or cap having surfaces which assist in seating the cap in position and retaining it once it has been seated.

Another object of the invention is a child resistant cap which has a locking tab to secure the cap in its closed position and resist unauthorized opening.

Another object is a child resistant cap in which the removable cap portion is connected to the body portion.

Another object is a child resistant cap in which the cap can be arranged to fit either flush with the body portion or surrounding the body portion.

Another object is a child resistant cap which can be formed independently of the container which it closes.

Other objects will appear from time to time in the following specification, drawings and claims.

DESCRIPTION OF THE PREFERRED EMBODIMENTS

Figure 1:
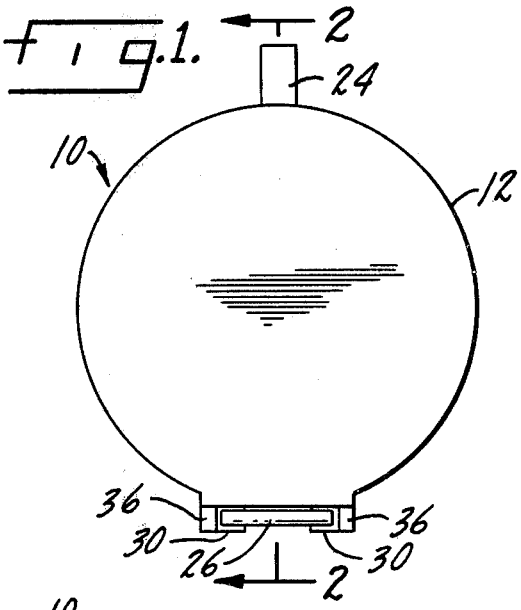
FIG. 1 is a plan view of a child resistant cap according to the present invention.

One embodiment of a child resistant cover or cap assembly 10 according to the present invention is illustrated in FIGS. 1–5. The cover assembly is molded from suitable plastic. The cover assembly 10 includes a generally circular cap 12 which has an inwardly projecting lip 14 on its underside. The cap 12 also has a circular bead 16 on its underside to provide a seal against the body portion of the cover assembly. Although a bead arrangement is shown, it will be understood that any number of sealing methods may be used including a plug arrangement or cap liner.

A tubular body portion 18 forms the neck of the container which the cover assembly is closing. At the top of the body portion 18 is an outlet 20 which is surrounded by a lip 22. The outlet is offset inwardly at 21 to provide a shoulder. The lip 22 will be described in detail below.

The cap 12 is connected to the body portion 18 by a flexible strap 24. On the side of the cap opposite the strap 24 is a locking tab 26. The tab consists of an H-section integrally hinged to the body as at 28. A pair of cap lugs 30 and a corresponding pair of body lugs 32 are arranged to interlock with the H-sections of the locking tab 26. Barrier ribs 36 are provided on either side of the cover and body lugs 30 and 32 to increase child resistance and provide tighter locking.

Figure 2:
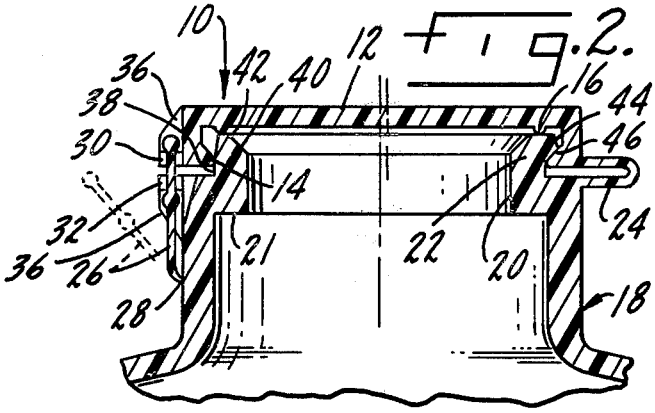
FIG. 2 is a sectional view taken substantially along line 2—2 of FIG. 1.
Figure 3:
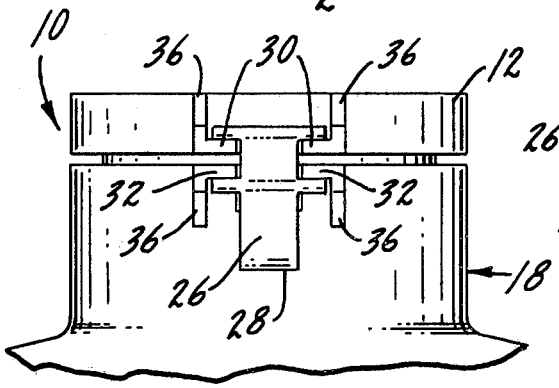
FIG. 3 is a side elevation view of a cap assembly, looking at the locking tab.
Figure 4:
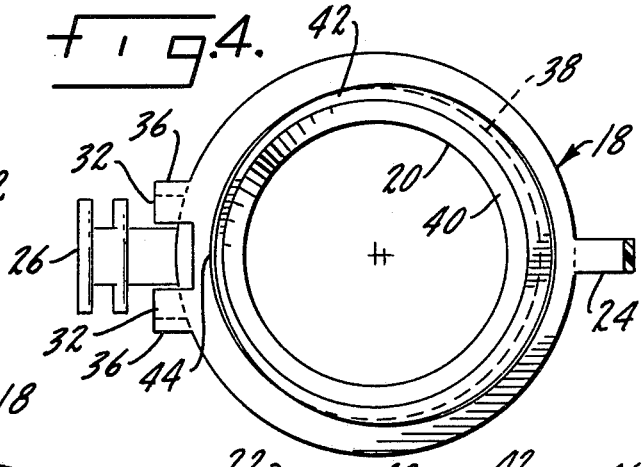
FIG. 4 is a plan view of the body portion of a cap assembly, showing the lip of the body portion.
Figure 5:
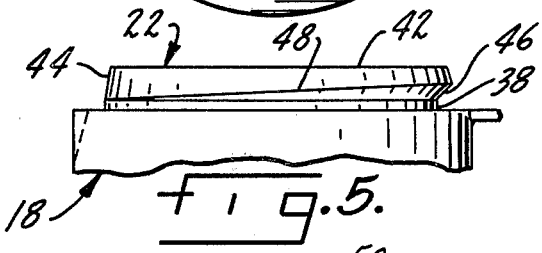
FIG. 5 is a partial side elevation view of the body portion lip.

Details of the lip 22 on the body portion 18 can be seen in FIGS. 2, 4 and 5. The base portion of the lip has an annular wall 38. On the interior surface of the outlet 20, there is an angled surface 40. This surface 40 faces inwardly and upwardly and extends to a top land 42 of the lip 22. The bead 16 of the cover is in contact with the top land 42 when the cover is closed. The outer edge of the top land 42 adjoins a first inclined surface 44 which faces outwardly and upwardly from the body portion 18. The first surface 44 is a cam surface, by which it is meant that the surface 44 assists in expanding the lip 14 of the cover so that it will snap over the lip 22 of the body portion. This will be explained in detail below.

Contiguous with the first surface 44 is a second inclined surface 46 which faces outwardly and downwardly from the body portion. The second surface 46 forms an undercut relative to the first surface 44, as seen at the right hand side of the lip 22 in FIGS. 2 and 5. This undercut portion serves as a cap retention means. The first surface 44 and the second surface 46 intersect at a junction line 48 which is inclined with respect to the outlet of the body portion. The second surface 46 gradually decreases toward the locking tab side of the lip until it merges entirely in the first surface 44. Thus, the second surface does not extend all the way around the lip 22. And there is no undercut portion on the locking tab side of the lip. Rather, the first surface 44 extends all the way from the top land 42 down to the wall 38.

The use and operation of the cap assembly are as follows. To seat the cap on the body portion, the user first engages the lip 14 of the cap with the retention means formed by the undercut surface 46 next to the strap 24. At this point the undercut is at its greatest extent and the retention means is most effective at that location. The remainder of the cap is pressed down on the cam surface 44. The sloping and inclined surface 44 aids in spreading the lip 14 of the cap out around the junction line of the cam surface and the undercut surface. This allows the lip 14 to snap into engagement with the lip 22. Stated another way, the cap lip 14 is engaged with the body portion lip 22 on the strap side and "wipes" around the cam surface 44 until it is entirely seated on the lip 22. Once the cap is seated, the locking tab 26 is pressed over the cover lugs 30 and the body lugs 32, thereby locking the body and cap together. To open the cap the user must press down on the cap and flip back the locking tab 26. Placing a finger between the lugs, the user pushes the cap 12 upward and off of the body portion lip 22.

Figure 6:
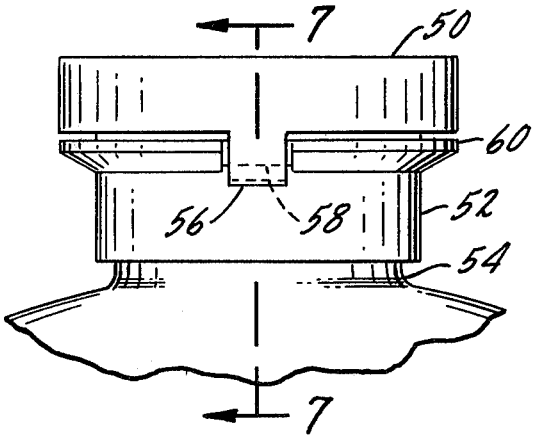
FIG. 6 is a side elevation view of an alternate embodiment of the invention.
Figure 7:
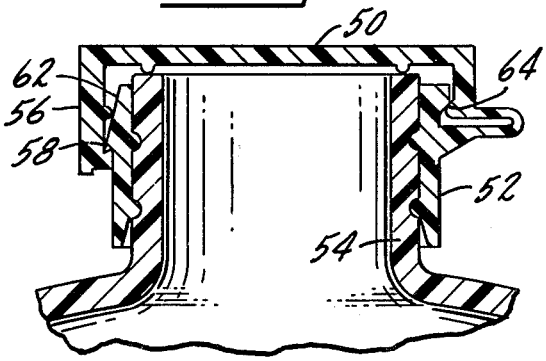
FIG. 7 is a sectional view taken substantially along line 7—7 of FIG. 6.

An alternate embodiment of the invention is shown in FIGS. 6 and 7. This embodiment has a cap 50 which extends over the body portion 52 rather than being flush as in the previous example. The body portion 52 is adapted to fit around the neck 54 of a container rather than being integrally molded with the container. There is a locking tab 56 formed as part of the cap. A corresponding hook 58 is formed on the body portion, the locking tab and hook being engageable to lock the parts together. A rib 60 on the body 52, below the cap 50 and extending along the sides of the locking stub 56 are features designed to make the closure child resistant. The body portion has surfaces 62 and 64 corresponding to the first and second surfaces 44 and 46 of the previous embodiment. Closure of the cap 50 is accomplished in a similar manner to that of the first embodiment, however, the locking the stub 56 does not have to be separately closed. To open the cap 50 the user merely pulls the stub 56 outwardly and then upwardly.

Whereas preferred forms of the invention have been shown and described, it will be understood that modifications and alterations could be made thereto without departing from the scope of the attached claims.

I claim:

1. A child resistant plastic cover assembly for a container, comprising:

a generally circular cap having an inwardly projecting lip on the underside thereof;

a tubular body portion having an outlet surrounded by a lip, the cap closing the outlet with the cap lip engaging the lip of the body portion when the cap is seated on the body portion;

the tubular body portion lip having a first inclined surface facing outwardly and upwardly from the body portion, and a second inclined surface contiguous to the first surface, the second inclined surface facing outwardly and downwardly from the body portion and forming an undercut, the first and second surfaces intersecting at a junction line which is inclined with respect to the outlet of the body portion such that the undercut forms a cap retention means while the first surface forms a cap seating means for seating the cap on said retention means.

2. The structure of claim 1 wherein the second surface extends less than all the way around the body portion lip.

3. The structure of claim 1 further comprising a strap connecting the cap to the body.

4. The structure of claim 1 further comprising a locking tab hinged to the body portion and engageable with the cap to seal the cap on the body portion.

5. The structure of claim 1 further comprising, a locking tab formed on the cap and a hook formed on the body portion, the locking tab and hook being engageable to seal the cap on the body portion.

* * * * *